US005078666A

United States Patent [19]

Porret et al.

[11] Patent Number: 5,078,666

[45] Date of Patent: Jan. 7, 1992

[54] CUT-TO-PRINT QUALITY MONITORING IN A PACKAGE PRODUCING MACHINE

[75] Inventors: Olivier Porret, Lausanne; Roger Roch, Cossonay-Ville, both of Switzerland

[73] Assignee: Bobst SA, Switzerland

[21] Appl. No.: 689,552

[22] Filed: Apr. 23, 1991

[30] Foreign Application Priority Data

Apr. 26, 1990 [CH] Switzerland ..... 01421/90

[51] Int. Cl.[5] ..... B31B 3/14; B31B 3/88

[52] U.S. Cl. ..... 493/1; 493/11; 493/53; 493/55

[58] Field of Search ..... 493/1, 2, 10, 11, 16, 493/53, 55, 56

[56] References Cited

U.S. PATENT DOCUMENTS 4,349,998 9/1982 Covert ..... 53/53

5,000,725 3/1991 Bauknecht ..... 493/11

FOREIGN PATENT DOCUMENTS 2225292 1/1973 Fed. Rep. of Germany ..... 493/1

2144355 3/1973 Fed. Rep. of Germany ..... 493/1

*Primary Examiner*—William E. Terrell

*Attorney, Agent, or Firm*—Hill, Van Santen, Steadman & Simpson

[57] ABSTRACT

A CAMERA-FLASH unit of a feeder table of an infeed station belonging to a machine converting sheets into package is disclosed. The CAMERA-FLASH unit shoots an image of the color register marks printed previously on every sheet. The CAMERA-FLASH unit operates jointly with an IMAGE PROCESSING SYSTEM having previously memorized a reference image from a model sheet. Owing to an image process comparison of the images shot from the successive sheets to the memorized image of the model, it is possible to check whether the quality criteria of the run are fulfilled.

12 Claims, 2 Drawing Sheets

CUT-TO-PRINT QUALITY MONITORING IN A PACKAGE PRODUCING MACHINE

BACKGROUND OF THE INVENTION

The present invention concerns a process and a device designed for monitoring the cut-to-print quality in a line of machines converting sheet-shaped workpieces into a package.

Package production, for instance of cardboard, whether or not corrugated, extends through at least three successive phases, i.e. printing and cutting, as well as folding and gluing. The quality of the final product thus depends on the quality of the different phases, each considered individually.

The present invention concerns essentially the monitoring of the cut-to-print quality. Up to now, printing was checked visually after the offset or rotogravure printing machine, i.e. an assistant trained for knowing the print quality criteria can, with sufficient practical work, gather an adequate amount of knowledge, experience and skill allowing him, with a short glance on the multi-color print provided in the corresponding printing units of a printing machine, to judge the print quality, i.e. to decide whether the print under examination is acceptable. If the print is actually acceptable, the printing machine continues its production which will then be carried towards the subsequent, i.e. cutting, machine. If the print is not acceptable, the operator of the printing machine will be informed thereof and will proceed with the control of the printing machine to the necessary modifications for the correction of the shortcomings of the print. Attention is drawn to the fact that printing can be done with the workpiece still having the shape of a web, or else of successive sheets travelling through.

The following shortcomings, though, can be attributed to the above considerations, i.e.:

checking cannot be permanent;

only an experienced and skilled person is able to check;

checking is not reliable since erroneous judgments are very likely to occur on account of objective criteria regarding the printing or cutting quality, this contingency being likely to grow with the scrutinizer's increasing fatigue;

the scrutinizer does not have the means for checking quality statistically in the course of production by recording the number of sheets meeting with certain printing quality criteria, for instance by proceeding to comprehensive simple and simultaneous checking of the four main quality criteria of which a description will follow hereafter with regard to printing and cutting as might be done in a package producing machine line;

such checking is monotonous and tiresome.

SUMMARY OF THE INVENTION

An object of the invention is to eliminate the above described shortcomings.

According to the invention, for monitoring cut-to-print quality on a line of machines converting sheet-shaped workpieces into a package, color reference marks are printed at an appropriate area of each sheet-shaped workpiece. A cutting station is preceded by an infeed appliance having an aligning table with front stop blocks and side guides. A camera-flash unit comprising a fixed camera operated jointly with an illumination unit and an imaging processing system views the workpieces in a proximity of the work table. In a first so-called teaching phase, at least one reference image of the marks on a reference model sheet is acquired with the reference sheet against the front stop blocks and side guides of the feeder table. In a second production phase, at least one process image of the marks is acquired for each sheet being processed. This acquired process image is compared to the reference image to determine by image processing position variations of the marks of the process workpieces with respect to the position of the marks on the reference model sheet. Variations are then checked to see whether they are within allowable limits.

DESCRIPTION OF THE PREFERRED EMBODIMENTS

Figure 1:
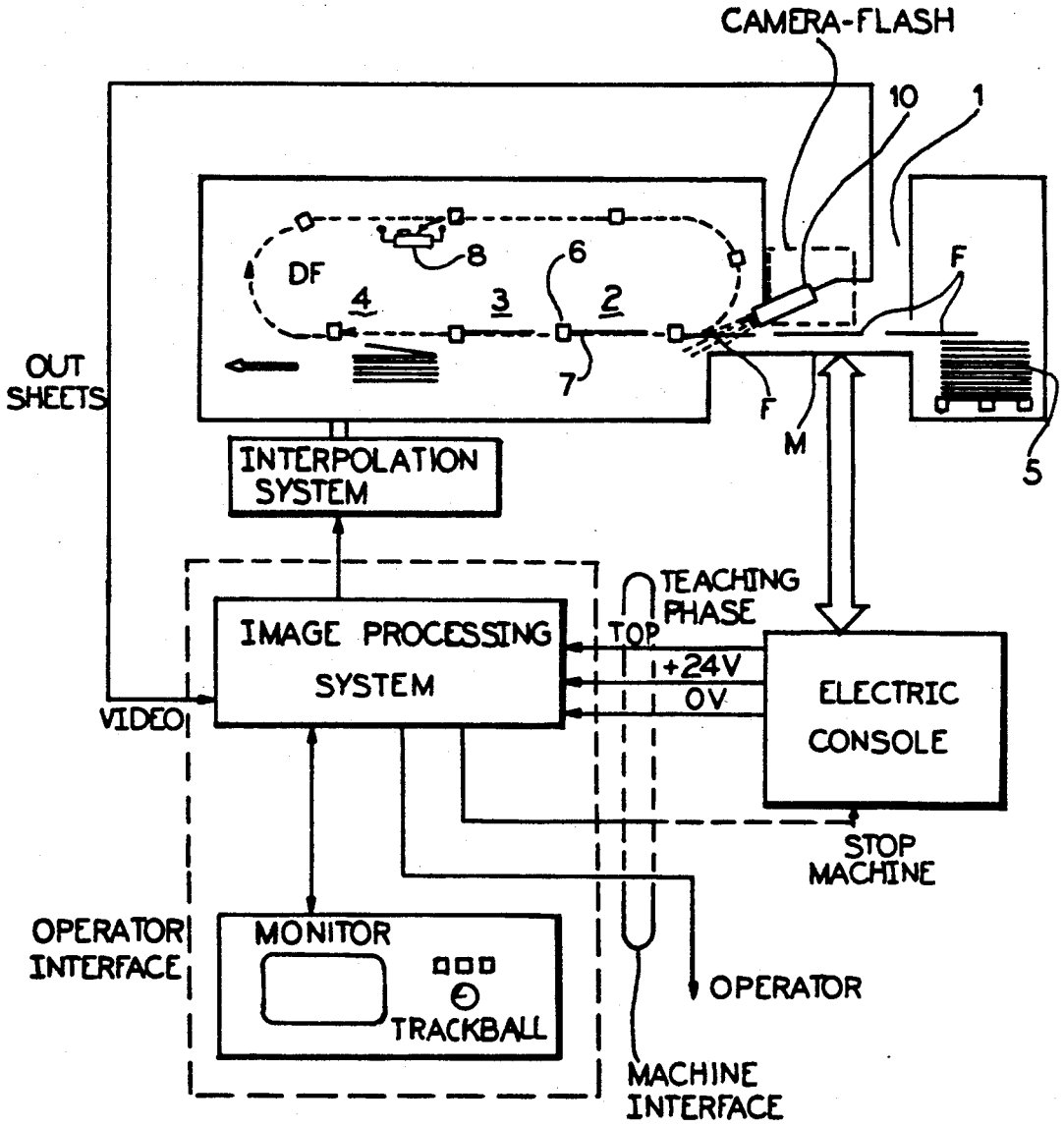
FIG. 1 shows a schematic assembly view of a cutting machine composed of the main components related to checking the cut-to-print quality together with the monitoring system of the invention.

FIG. 1 illustrates a machine including an infeed station 1, a cutting station 2, a waste-stripping station 3, and a blank delivery unit 4. Summed up, the front edge strips of the sheets F taken one by one from the batch 5 are inserted into gripper bars 6 carried by a chain pair 7. The sheets F are then carried through the various processing stations 2, 3, 4 in which every operation is effectuated with the gripper bars 6 at standstill.

Figure 2:
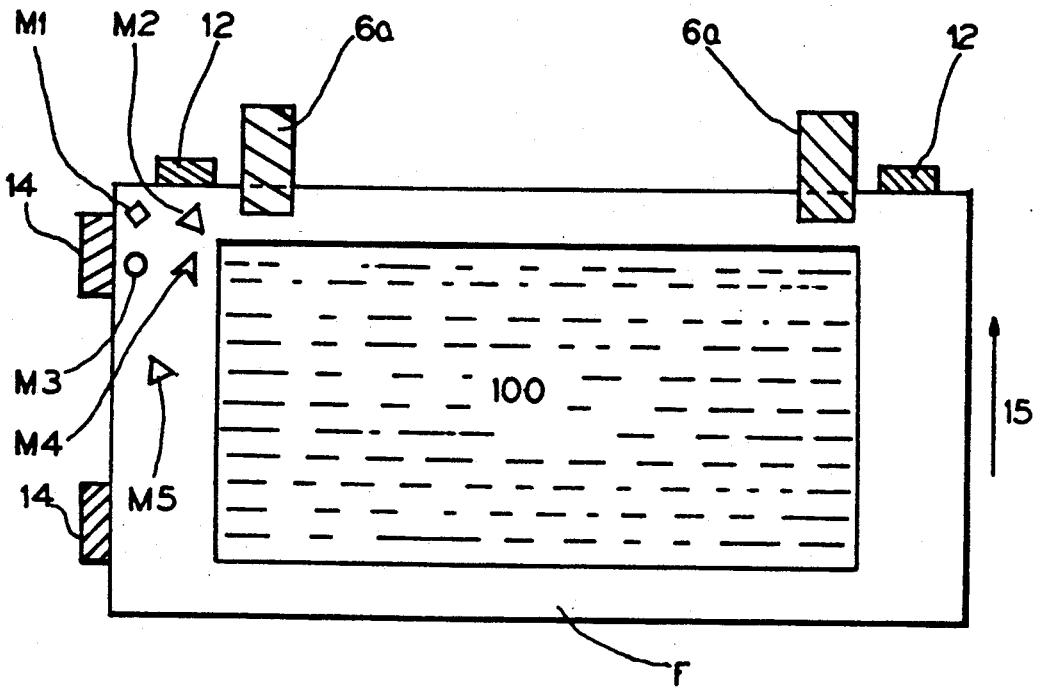
FIG. 2 is a simplified top view of a feeder table.
Figure 3:
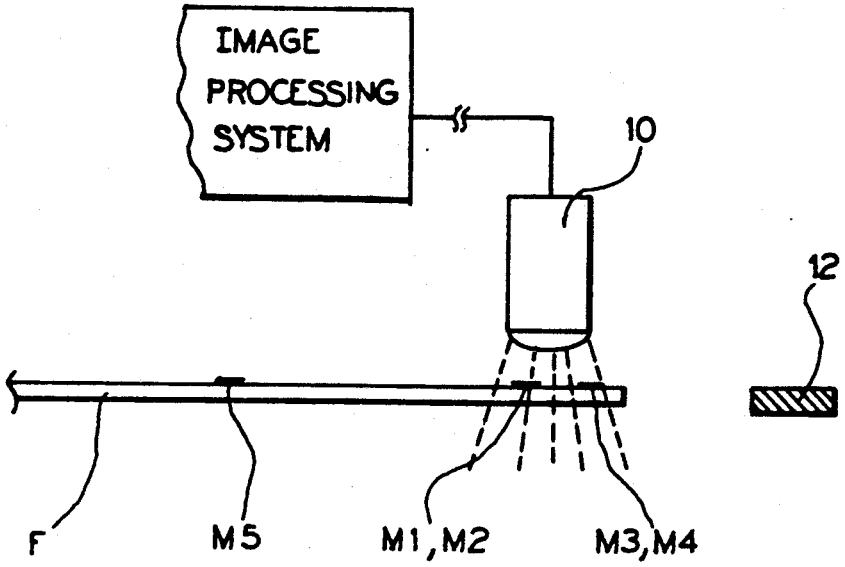
FIG. 3 is a partial side view showing the camera used in the invention of FIG. 2.

In the infeed station 1, every sheet F previously printed is taken from a batch 5 in order to be carried onto the feeder table M. The table M has the purpose of ensuring a lengthwise and crosswise positioning of the sheet with respect to the processing tools, for instance cutting tools, of the machine. Such a positioning is obtained by means of front stop blocks 12 and side guides 14, as shown schematically in FIG. 2, the sheet being moved along in the direction of the arrow 15. The front stop blocks 12 and side guides 14 thus also have the function of correctly positioning the sheet with respect to the grippers 6a of the conveyor bar 6, the grippers 6a being designed to seize the front edge strip of the sheet F. The print 100 may consist of one or several identical juxtaposed motifs, every motif corresponding to a package after blanking. For checking the print, five color register marks $M_1$–$M_5$ are also printed on the sheet F, as is known in the prior art. For this purpose, four initial marks $M_1$–$M_4$ each corresponding to a color of a four color printer are to be printed on the lateral strip and very close to the front edge of the sheet F. Appropriately, these marks are to be arranged so as to form a square. The fifth mark $M_5$ is also printed on the lateral strip of the sheet F, i.e. outside the print area 100 but offset rearwardly. Preferably, if viewed in the travelling direction 15, the mark $M_5$ is situated exactly on the extension line starting from the center of the square formed by the four marks $M_1$–$M_4$.

In the infeed station I, a so-called CAMERA-FLASH unit is arranged exactly above and opposite the passage of the marks $M_1$–$M_5$. A first image called $I_1$ of the four marks $M_1$–$M_4$ is then shot by the CAMERA-FLASH unit by means of the camera 10.

As shown by FIG. 1, the CAMERA-FLASH unit operates jointly with the schematic units identified:

IMAGE PROCESSING SYSTEM
OPERATOR INTERFACE
ELECTRIC CONSOLE
INTERPOLATION SYSTEM
MACHINE INTERFACE

MONITOR visualizing images, parameters and results in the form of different screens identified MAIN MENU and keys for scrolling, memorization, stopping and selection identified TRACKBALL, STORE, STOP, SELECT.

The purpose of the four marks $M_1$–$M_4$ is to allow a check to be made of the below itemized details, i.e. whether:

a sheet is not inversed through 180°;

all colors are printed;

the lengthwise and crosswise t-to-print misregister allowances are maintained;

the lengthwise and crosswise cut-to-print misregister allowances are maintained.

These checks are carried out in the following way. A CAMERA-FLASH unit comprises a fixed camera (10) operating jointly with an illumination unit, and a so-called IMAGE PROCESSING SYSTEM allowing to view and to memorize in a first so-called TEACHING phase at least one image $I'_1$ of the marks $M'_1$–$M'_4$ on the basis of a sheet F' considered as a reference model; then, in a second so-called PRODUCTION phase, to view and scan at least one image $I_1$ of the marks $M_1$–$M_4$ of every sheet F processed and considered as a sample. The image $I_1$ of each of these samples is compared to the image $I'_1$ of the reference model F' so as to determine by image processing the position variations of the marks $M_1$–$M_4$ related to each sample F with respect to the position of those marks $M'_1$–$M'_4$ related to the reference model F'. This checks whether the variations are kept within the allowance values applicable to the positioning of the marks $M_1$–$M_4$ input into the data processing unit.

As soon as the sheet F has come to a standstill against front stop blocks 12 and also against the side guides 14, a second image $I_2$ of the fifth mark $M_5$ is shot, the camera 10 being arranged with respect to the front stop blocks and side guides 12, 14 in such a way that the mark $M_5$ is positioned at this instant in the center of its scanning field.

The purpose of the mark $M_5$ is to allow checking whether the position misregister allowances of the print 100 with respect to the edge of the sheet F are kept. As described above with respect to the marks $M_1$–$M_4$, the last check is to be carried out by comparing to an image $I'_2$ of the reference model F' an image $I_2$ of the mark $M_5$ related to the successive sheets F being processed, and called samples.

In this way, it is possible to check whether all successive sheets F meet with the aforementioned quality criteria by comparing the two images $I'_1$, $I'_2$ of a sheet F' travelling in the course of production on the feeder table M to the two corresponding images I' , $I'_2$ of a reference model F' made previously under conditions identical to those of the production.

The results of this checking method can be used in various ways. In the event of a sheet F failing to meet with all criteria, there is a possibility, for instance, to stop the machine or to prevent the sheet F from being seized by the grippers 6, **6*a*** so as to have it ejected.

Further details concerning the applicability of the marks $M_1$–$M_5$ and their processing by the IMAGE PROCESSING SYSTEM are contained in the Swiss patent application filed by Bobst S.A. (inventor Olivier Porret) on Apr. 18, 1990 and entitled "Checking of Printing and Cutting Quality in a Package Producing Installation", U.S. Ser. No. 07/687,241, and incorporated herein by reference.

The advantage of the system with two fields or scanning targets $M_1$–$M_4$ and $M_5$ is that it increases the lapse of time available for checking. In fact, in machines as presently known with a production speed of up to 10,000 sheets per minute, the time necessary for the sheets in standstill against the front stop blocks 12 is 25 milliseconds. However, during such a short-time interval, it is actually difficult to have the IMAGE PROCESSING SYSTEM carry out all checking operations. So, by shooting the first image $I_1$ with the sheet F which has not yet reached the front stop blocks 12, it has become possible to increase by 150 milliseconds the time available for checking, the aforesaid period of 150 milliseconds corresponding to the time needed by the sheet F to reach the front stop blocks 12 and beginning when the four marks $M_1$–$M_4$ travel through under the camera 10. The 150 milliseconds will thus be used for processing the image $I_1$. The 25 milliseconds of the standstill will, however, be sufficient for processing the image $I_2$ since it concentrates only on the single mark $M_5$.

The above-described process also has the advantage of allowing to check the position of the front stop blocks 12 and side guides 14 with respect to the tools of the cutting station. In fact, any possible variation or drifting-off of the front stop blocks 12 and side guides 14 will be automatically detected since it will entail the displacement of the marks $M_1$–$M_5$ in the visual field of the camera 10.

In an appropriate way and especially so for processing full, i.e. non-corrugated, board, the camera 10 is put to operation jointly with a special optical system designed for scanning very small marks with a diameter of some 1/10 mm, and thus invisible to the naked eye. Owing to such an optical system, it is easier to determine an adequate area for arranging the marks $M_1$–$M_5$.

Although various minor changes and modifications might be proposed by those skilled in the art, it will be understood that we wish to include within the claims of the patent warranted hereon all such changes and modifications as reasonably come within our contribution to the art.

I claim as my invention:

1. A method for monitoring cut-to-print quality on a line of machines converting sheet-shaped workpieces into a package wherein at least one color reference mark is printed by each printing unit in an appropriate area of the workpiece, and wherein at least one cutting station is preceded by an infeed station having an aligning table with front stop block means and side guide means, comprising steps of:

providing a camera-flash unit including a fixed camera positioned in a region of the infeed station and wherein said fixed camera operates directly with an illumination unit and an image processing system for viewing workpieces and memorizing images;

in a first teaching phase, a reference model sheet is positioned against the front stop block means and side guide means of the feeder table and at least one reference image is obtained;

in a second production phase, scanning each workpiece being processed to obtain at least one process image for each workpiece; and comparing the process image to the reference image to determine position variations of the marks on the process workpieces vis-a-vis the marks on the reference model sheet and checking whether the variations are within allowable limits.

2. A method according to claim 1 wherein the comparison is utilized to determine whether a sheet is not reversed through 180°, whether all colors are printed, whether lengthwise and crosswise print-to-print misregister allowances are maintained, and whether lengthwise and crosswise cut-to-print misregister allowances are maintained.

3. A method according to claim 1 including the steps of:

providing a cluster of marks with a mark in the cluster being provided for each printing unit for checking color register;

providing an additional mark on the workpieces rearwardly offset with respect to the cluster of marks;

shooting with the camera a first image of the cluster of marks at a first stage when the sheet is still moving toward the front stop block means; and shooting a second image with the camera of the additional mark with the sheet at a second stage wherein it is at standstill against the front stop blocks.

4. A method according to claim 3 including the steps of:

with the reference model sheet, obtaining first and second reference images, one of which corresponds to the cluster of marks and the other of which corresponds to the additional mark; and comparing the first reference image to the first image obtained at the first stage, and comparing the second reference image to the second image obtained at the second stage.

5. A method according to claim 1 including the step of providing a warning in a course of production when mark variations are outside said allowable limits for alerting an operator to act on the machine for correcting a problem which has developed.

6. A method according to claim 5 wherein the operator stops production of the machine when the problem has developed.

7. A method according to claim 5 wherein the operator activates a device for automatic ejection for defective sheets when the problem has developed.

8. A method for monitoring quality on a line of machines converting sheet-shaped workpieces into a package wherein at least one color reference mark is printed by a printing unit in an appropriate area of the workpiece, and wherein an aligning table with front stop block means and side guide means is provided for aligning a workpiece, comprising steps of:

providing a camera and associated image processing system positioned in a region of the aligning table for viewing workpieces and memorizing images;

in a first teaching phase, a reference model sheet is positioned against the front stop block means and side guide means of the feeder table and at least one reference image is obtained;

in a second production phase, scanning at least some of the workpieces being processed to obtain at least one process image for each workpiece scanned; and comparing the process image to the reference image to determine position variations of the marks on the process workpieces vis-a-vis the marks on the reference model sheet and checking whether the variations are within allowable limits.

9. A method according to claim 8 including the steps of:

providing a cluster of marks with a mark in the cluster being provided for each printing unit for checking color register;

providing an additional mark on the workpieces offset with respect to the cluster of marks;

shooting with the camera a first image of the cluster of marks at a first stage when the sheet is still moving toward the front stop block means; and shooting a second image with the camera of the additional mark with the sheet at a second stage wherein it is at standstill against the front stop blocks.

10. A system for monitoring cut-to-print quality on a line of machines converting sheet-shaped workpieces into a package wherein at least one color reference mark is printed by each printing unit in an appropriate area of the workpiece, comprising:

at least one cutting station preceded by an infeed station having an aligning table with front stop block means and side guide means for aligning each workpiece;

camera means positioned in a region of the infeed station and operating directly with an illumination unit and an image processing means for viewing workpieces and memorizing images;

said camera means and image processing means obtaining at least one reference image in a first teaching phase when a reference model sheet is positioned against the front stop block means and side guide means of the feeder table;

said image processing means and camera means obtaining at least one process image for each workpiece in a second production phase when scanning workpieces being processed; and said image processing means comparing the process image to the reference image to determine position variations of the marks on the process workpieces vis-a-vis the marks on the reference model sheet and checking whether the variations are within allowable limits.

11. A device according to claim 10 wherein an operate interface means is connected to the image processing system having means for visualizing images and keys for scrolling, memorization, stopping and selection.

12. A method for monitoring quality on a line of machines converting sheet-shaped workpieces into a package wherein a color reference mark is printed by each of a plurality of printing units in a cluster at a first area of the workpiece, and at least one additional mark for determining misregister with respect to sheet edge is printed on each workpiece at a second area displaced from the first, and wherein at least one cutting station is preceded by an infeed station having an aligning table with front stop block means and side guide means, comprising steps of:

providing a camera unit with an image processing system in a region of the infeed station for viewing workpieces and memorizing images;

in a first teaching phase, a reference model sheet is positioned against the front stop block means and side guide means of the feeder table and reference images are obtained for the cluster and the additional mark;

in a second production phase, scanning workpieces being processed to obtain at least one process image for the cluster and at least one process image for the additional mark; and comparing the process images to the reference images to determine position variations of the marks on the process workpieces vis-a-vis the marks on the reference model sheet and checking whether the variations are within allowable limits.

* * * * *